US010152022B2

(12) United States Patent
Wang et al.

(10) Patent No.: US 10,152,022 B2
(45) Date of Patent: Dec. 11, 2018

(54) CARTRIDGE TOP COVER AND CARTRIDGE HAVING THE SAME

(71) Applicant: CET Group Co., Ltd., Beijing (CN)

(72) Inventors: Hongbin Wang, Beijing (CN); Bo Chen, Beijing (CN)

(73) Assignee: CET Group Co., Ltd., Beijing (CN)

( * ) Notice: Subject to any disclaimer, the term of this patent is extended or adjusted under 35 U.S.C. 154(b) by 0 days.

(21) Appl. No.: 15/824,978

(22) Filed: Nov. 28, 2017

(65) Prior Publication Data

US 2018/0081321 A1 Mar. 22, 2018

(30) Foreign Application Priority Data

Nov. 29, 2016 (CN) ..... 2016 1 1072098

(51) Int. Cl.
*G03G 15/08* (2006.01)
*G03G 21/18* (2006.01)

(52) U.S. Cl.
CPC ..... *G03G 21/1814* (2013.01); *G03G 15/0867* (2013.01); *G03G 21/1842* (2013.01); *G03G 21/1857* (2013.01); *G03G 2215/0668* (2013.01)

(58) Field of Classification Search
CPC ..... G03G 15/0832; G03G 15/0837; G03G 15/0867; G03G 15/087; G03G 15/0872; G03G 2215/0663; G03G 2215/0668; G03G 2215/0678; G03G 21/1814; G03G 21/1842; G03G 21/1857
See application file for complete search history.

(56) References Cited

U.S. PATENT DOCUMENTS

2014/0079441 A1* 3/2014 Abler ..... G03G 15/0872 399/262

FOREIGN PATENT DOCUMENTS

WO WO 2017/120699 A1 * 7/2017

* cited by examiner

*Primary Examiner* — Sophia S Chen

(57) ABSTRACT

A cartridge top cover includes a drive coupler, a cartridge top cover housing and a rotary cap. Two notches are respectively provided on both sides of a top portion of the cartridge top cover housing, the rotary cap has a toner outlet which is selectively communicated with the notches, a driving member is located inside the cartridge top cover housing, the driving member is in clearance fit with the cartridge top cover housing, the drive coupler is located at the top portion of the cartridge top cover housing, a transmission rod is located at a bottom of the drive coupler, the transmission rod is sleeved through the top portion of the cartridge top cover housing and is connected with the driving member by a one-way bearing which is fixed inside the driving member. The present invention also provides a cartridge including a cartridge body and the cartridge top cover.

19 Claims, 3 Drawing Sheets

CARTRIDGE TOP COVER AND CARTRIDGE HAVING THE SAME

CROSS REFERENCE OF RELATED APPLICATION

The present invention claims priority under 35 U.S.C. 119(a-d) to CN 201611072098.7, filed Nov. 29, 2016.

BACKGROUND OF THE PRESENT INVENTION

Field of Invention

The present invention relates to a field of printer and copier accessories, and particularly to a cartridge top cover and a cartridge having the cartridge top cover.

Description of Related Arts

Cartridge is a key component of a copier or printer and is used for storing and transferring toner. In use, the cartridge is driven to rotate by a driving device of the copier or printer, so as to achieve toner supply. In practical operation, the driving device of the copier or printer needs to rotate reversely at a certain angle prior to rotating forwardly. Because a drive coupler fixed at an upper portion of the cartridge is engaged with the driving device of the copier or printer, under the drive of the driving device, a cartridge body follows the drive coupler to rotate reversely at a certain angle prior to toner dispense. The reverse rotation of the cartridge body is meaningless to copying and printing and increases the energy consumption of the copier or printer. Further, the reverse rotation easily causes damage to peripheral members of the cartridge.

SUMMARY OF THE PRESENT INVENTION

An object of the present invention is to provide a cartridge top cover and a cartridge having the cartridge top cover, which are able to reduce the energy consumption and avoid the equipment damage caused by reverse rotation of the cartridge.

To solve the above technical problems, the present invention provides technical solutions as follows.

A cartridge top cover comprises a drive coupler, a cartridge top cover housing and a rotary cap rotatably located inside the cartridge top cover housing, wherein: two notches are respectively provided on both sides of a top portion of the cartridge top cover housing, the rotary cap has a toner outlet which is selectively communicated with the notches, a driving member capable of being engaged with the rotary cap is located inside the cartridge top cover housing, the driving member is in clearance fit with the cartridge top cover housing, the drive coupler is located at the top portion of the cartridge top cover housing, a transmission rod is located at a bottom of the drive coupler by screws, the transmission rod is sleeved through the top portion of the cartridge top cover housing and is connected with the driving member by a one-way bearing which is fixed inside the driving member.

Further, multiple toothed portions are located at a side of the rotary cap facing toward the driving member, multiple drive teeth for engaging with the rotary cap are located at a side of the driving member facing towards the rotary cap; each drive tooth has an upright edge along a rotational direction thereof, and an arc edge which is opposite to the upright edge and defined by gradually widening each drive tooth from a tip thereof.

Further, every notch has a notch edge provided at the top portion of the cartridge top cover housing.

Further, multiple longitudinal grooves are uniformly provided on an outer side of the one-way bearing, and multiple fixed ribs are integrally formed at an inner side of the driving member for being engaged with the longitudinal grooves.

Further, a seal ring is located inside the driving member for fitting with an end surface of the one-way bearing.

Further, a driving member protective case is sleeved to a rear portion of the driving member.

Further, each toothed portion has a curved edge along a rotational direction thereof which fits with the arc edge of each drive tooth, and a right-angel edge which is opposite to the curved edge and fits with the upright edge of each drive tooth.

Further, multiple supporting sheets, which are in clearance fit with each other, are located at a top of the drive coupler; multiple stoppers are respectively located at the supporting sheets for being engaged with the driving device; each stopper has an included angle in a range of 80° to 85°.

Further, a circlip is fixed at a bottom of the transmission rod;

a spring is located between the rotary cap and the driving member, a fixed ring is located between the rotary cap and the spring, and a PET (Polyethylene terephthalate) pad is located between the rotary cap and the fixed ring.

A cartridge comprises a cartridge body and a cartridge top cover located at an upper portion of the cartridge body, wherein the cartridge top cover is the above-mentioned cartridge top cover.

The present invention has beneficial effects as follows.

In operation, the drive coupler is engaged with the driving device of the copier or printer; the driving device drives the drive coupler to rotate, the transmission rod which is fixed at the bottom of the drive coupler is able to slide up and down and rotate, and transfers the torque force to the driving member under the drive of the drive coupler; under the drive of the driving member, the toner outlet of the rotary cap is selectively communicated with the notches of the cartridge top cover housing, so as to further enable or disenable the toner to flow out.

In the present invention, because the transmission rod is engaged with the one-way bearing and has the characteristic of unidirectional rotation, the transmission rod is able to directionally rotate relatively to the driving member in which the one-way bearing is provided. When the drive coupler rotates reversely under the drive of the driving device, the rotation of the transmission rod is unable to drive the driving member to rotate reversely, so that the cartridge body is unable to rotate reversely. After completing the reverse rotation, the driving device drives the drive coupler to rotate forwardly, and the transmission rod drives the driving member to rotate forwardly. Under the action of the driving member, the rotary cap drives the cartridge body to rotate and dispense toner, and cooperates with other parts of the printer and copier to complete printing or copying.

Because the present invention has the characteristic of unidirectional rotation, the cartridge body does not follow the drive coupler when the driving device rotates reversely. Therefore, compared with the prior art, the present invention reduces the energy consumption and avoids the equipment damage caused by the reverse rotation of the cartridge.

Figure 1:
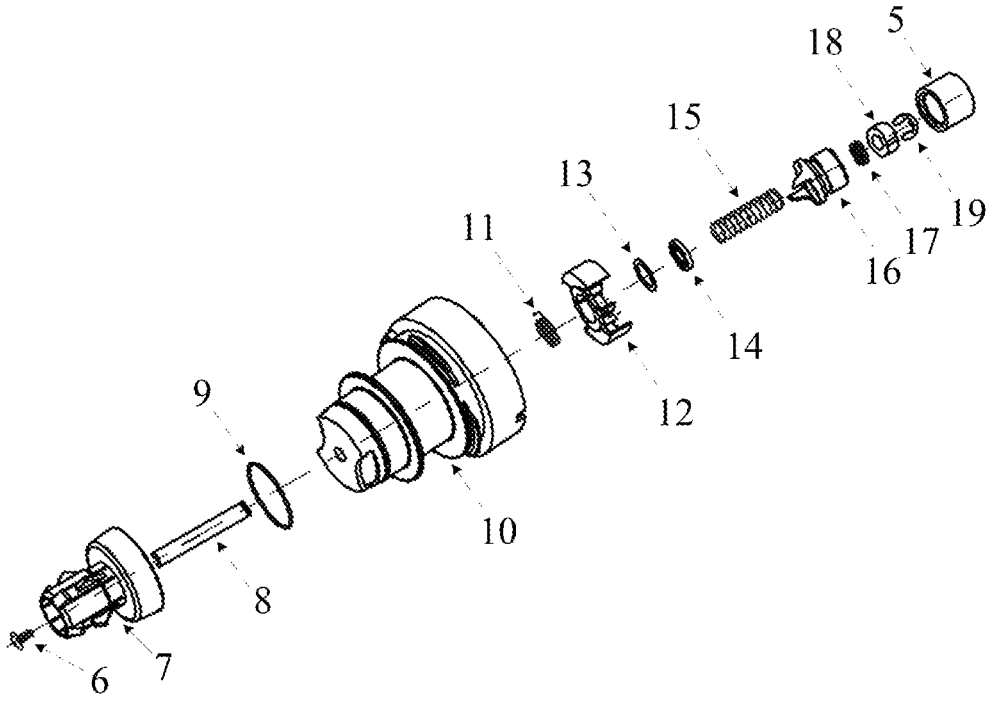
FIG. 1 is an explosive view of a cartridge top cover according to the present invention.

In the drawings, 1: cover; 2: cartridge body; 3: cartridge anti-bug piece; 4: mark for black cartridge; 5: driving member protective case; 6: screws; 7: drive coupler; 71: supporting sheets; 71*a*: stopper; 72: included angle; 8: transmission rod; 9: O-shaped ring; 10: cartridge top cover housing; 101: notch; 102: round hole; 103: notch edge; 104: positioning column; 11: return spring; 12: rotary cap; 121: annular side plate; 122: toner outlet; 123: toothed portion; 1231: curved edge; 1232: right-angel edge; 124: annular positioning plate; 13: PET pad; 14: fixed ring; 15: spring; 16: driving member; 161: drive tooth; 162: arc edge of drive tooth; 163: upright edge of drive tooth; 164: fixing ribs; 17: seal ring; 18: one-way bearing; 181: longitudinal groove; 19: spring ring; 20: cartridge top cover seal ring; 21: toner feeding holder.

DETAILED DESCRIPTION OF THE PREFERRED EMBODIMENT

To further clarify the technical problems, technical solutions and advantages of the present invention, a detailed description will be illustrated with reference to the drawings and specific examples.

Figure 2:
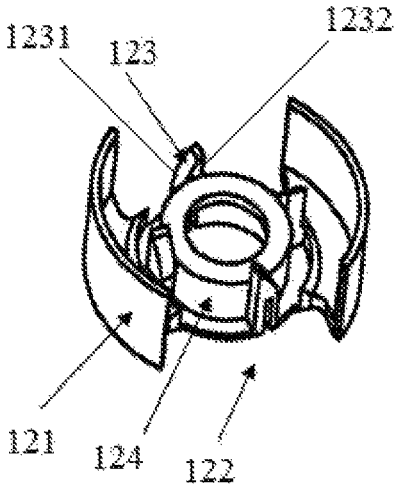
FIG. 2 is a structurally schematic view of a rotary cap of the cartridge top cover according to the present invention.

In one aspect, the present invention provides a cartridge top cover as shown in FIG. 1, comprising a drive coupler 7, a cartridge top cover housing 10 and a rotary cap 12 rotatably located inside the cartridge top cover housing 10, wherein two notches 101 are respectively provided on both sides of a top portion of the cartridge top cover housing 10; the rotary cap 12 has a toner outlet 122 (as shown in FIG. 2) which is selectively communicated with the notches 101; a driving member 16 able to be engaged with the rotary cap 12 is located inside the cartridge top cover housing 10; the driving member 16 is in clearance fit with the cartridge top cover housing 10; the drive coupler 7 is located at the top portion of the cartridge top cover housing 10; a transmission rod 8 is fixed at a bottom of the drive coupler 7 by screws, and is sleeved through the top portion of the cartridge top cover housing 10 and is connected with the driving member 16 by a one-way bearing 18 which is fixed inside the driving member 16.

In the specific operation of the present invention, the drive coupler 7 is engaged with a driving device of a copier or printer; the driving device drives the drive coupler 7 to rotate, the transmission rod 8 fixed to the bottom of the drive coupler 7 is able to slide up and down and rotate, and transfers a torque force to the driving member 16 under a drive of the drive coupler 7; under a drive of the driving member 16, the toner outlet 122 of the rotary cap 12 is selectively communicated with the notches 101 of the cartridge top cover housing 10, for further enabling or disenabling toner to flow out.

In the present invention, because the transmission rod 8 is engaged with the one-way bearing 18 and has a characteristic of unidirectional rotation, the transmission rod 8 is able to directionally rotate relatively to the driving member 16 in which the one-way bearing 18 is provided. When the drive coupler 7 rotates reversely under a drive of the driving device, the rotation of the transmission rod 8 is unable to drive the driving member 16 to rotate reversely, so that the cartridge body 2 is unable to rotate reversely. After completing the reverse rotation, the driving device drives the drive coupler 7 to rotate forwardly, the transmission rod 8 drives the driving member 16 to rotate forwardly; under an action of the driving member 16, the rotary cap 12 drives the cartridge body 2 to rotate and dispense the toner, and cooperates with other parts of the printer and copier to complete printing or copying.

Because the present invention has the characteristic of unidirectional rotation, the cartridge body 2 does not follow the drive coupler 7 when the driving device rotates reversely. Therefore, compared with the prior art, the present invention reduces the energy consumption and avoids the equipment damage caused by the reverse rotation of the cartridge.

Figure 3:
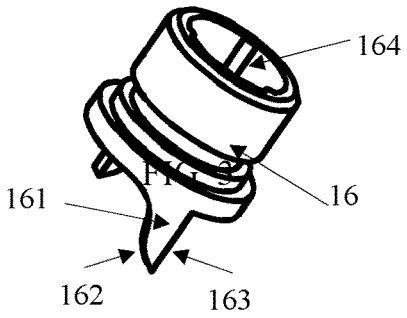
FIG. 3 is a structurally schematic view of a driving member of the cartridge top cover according to the present invention.

As an improvement of the present invention, as shown in FIGS. 2 and 3, multiple toothed portions 123 are located at a side of the rotary cap 12 facing toward the driving member 16, and multiple drive teeth 161 for engaging with the rotary cap 12 are located at a side of the driving member 16 facing towards the rotary cap 12. Each drive tooth 161 has an upright edge 163 along a rotational direction thereof, and an arc edge 162 which is opposite to the upright edge 163 and defined by gradually widening each drive tooth 161 from a tip thereof.

When the present invention works, under the drive of the driving device of the copier or printer, the drive coupler 7 slides up and down on the top portion of the cartridge top cover housing 10, so as to continuously engage and disengage the drive teeth 161 with the toothed portions. In the prior art, a top portion of both the drive teeth 161 and the toothed portions is beveled, so that when the drive teeth 161 are respectively engaged with the toothed portions, the drive teeth 161 are easy to hit against the toothed portions, which causes unsuccessful engagement. In order to overcome the above-mentioned drawbacks, each drive tooth 161 has the upright edge 163 along the rotational direction thereof, and the arc edge 162 which is opposite to the upright edge 163 and defined by gradually widening each drive tooth 161 from the tip thereof, so that no matter how the drive teeth 161 are respectively engaged with the toothed portions at a certain angle, the drive teeth 161 are able to be smoothly inserted into gaps between the toothed portions for further being engaged with the toothed portions, thus the above improvement guarantees the stability of the copier or printer.

Figure 4:
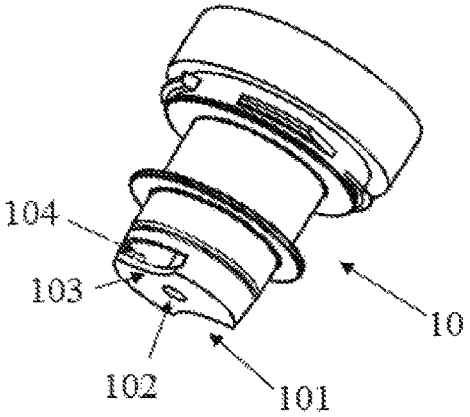
FIG. 4 is a structurally schematic view of a cartridge top cover housing of the cartridge top cover according to the present invention.

In order to enlarge openings of the notches 101 and facilitate the toner flowing out, every notch 101 has a notch edge 103 provided at the top portion of the cartridge top cover housing 10. Preferably, the notch edge 103 is arc-shaped, as shown in FIG. 4.

In the present invention, the transmission rod 8 is sleeved through the top portion of the cartridge top cover housing 10 through a round hole 102 provided at a top of the cartridge top cover housing 10.

Figure 5:
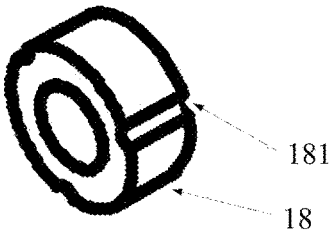
FIG. 5 is a structurally schematic view of a one-way bearing of the cartridge top cover according to the present invention.

As a further improvement on the present invention, as shown in FIG. 5, multiple longitudinal grooves 181 are uniformly provided on an outer side of the one-way bearing 18, and multiple fixing ribs 164 for respectively engaging with the longitudinal grooves 181 are integrally formed at an inner side of the driving member 16. Preferably, an amount of the longitudinal grooves 181 is three. The longitudinal grooves 181 are respectively engaged with the fixing ribs 164 to prevent a relative rotation between the one-way bearing 18 and a housing of the driving member 16, so as to further improve the stability of the present invention.

In the present invention, a seal ring 17, which fits with an end surface of the one-way bearing 18, is located inside the driving member 16. The seal ring 17 is able to prevent external dust, water or foreign matters from entering the one-way bearing 18 and prevent lubricating oil from spilling.

In order to prevent the toner from entering the driving member 16, a driving member protective case 5 is sleeved to a rear portion of the driving member 16. Preferably, the driving member protective case 5 is made of silica gel.

Further, each toothed portion 123 has a curved edge 1231 along a rotational direction thereof which fits with the arc edge 162 of each drive tooth 161, and a right-angel edge 1232 which is opposite to the curved edge and fits with the upright edge 163 of each drive tooth 161.

Preferably, an amount of the drive teeth 161 is two, and an amount of the toothed portions is four.

Figure 6:
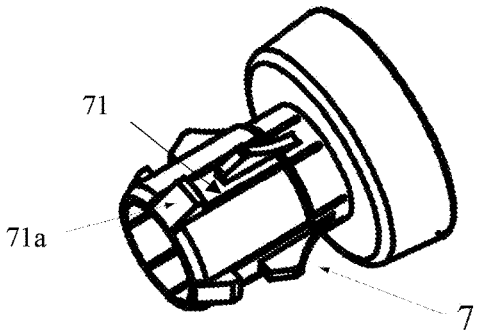
FIG. 6 is a structurally schematic view of a drive coupler of the cartridge top cover according to the present invention.
Figure 7:
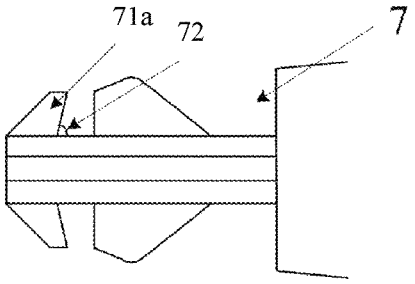
FIG. 7 is a side view of the drive coupler of the cartridge top cover according to the present invention.

In the present invention, as shown in FIG. 6, multiple supporting sheets 71, which are in clearance fit with each other, are located at a top of the drive coupler 7. Multiple stoppers 71*a* for engaging with the driving device are respectively located at the supporting sheets. As shown in FIG. 7, an included angle 72 of the stoppers 71*a* is in a range of 80° to 85°. In operation, the driving device of the printer or copier is engaged with the drive coupler 7. However, in the prior art, the included angle of the stoppers 71*a* is 90°, so when the driving device is engaged with the stoppers 71*a*, the detachment easily occurs due to unstable engagement, which causes that the printer or copier is unable to work normally. In order to overcome the above-mentioned drawbacks, the included angle 72 of the stoppers 71*a* is in the range of 80°-85° in the present invention, which enables the driving device to be more closely engaged with the drive coupler 7, so as to avoid disengagement therebetween.

As a further improvement of the present invention, a circlip 19, which is able to prevent an axial movement of the transmission rod 8 for meeting operating conditions, is fixed at the bottom of the transmission rod 8.

Further, a spring 15 is located between the rotary cap 12 and the driving member 16, a fixed ring 14 is located between the rotary cap 12 and the spring 15, and a PET (Polyethylene terephthalate) pad 13 is located between the rotary cap 12 and the fixed ring 14.

As shown in FIG. 2, the rotary cap 12 comprises an annular side plate 121 on which the toner outlet 122 is provided. An annular positioning plate 124 is located at an inner side of the annular side plate 121, and an annular toothed portion (not shown in the drawings) is located at an outer side of the annular positioning plate 124; a return spring 11 is sleeved to an inner side of the annular positioning plate 124.

A positioning column 104 for restriction is located inside the top portion of the cartridge top cover housing 10.

Figure 8:
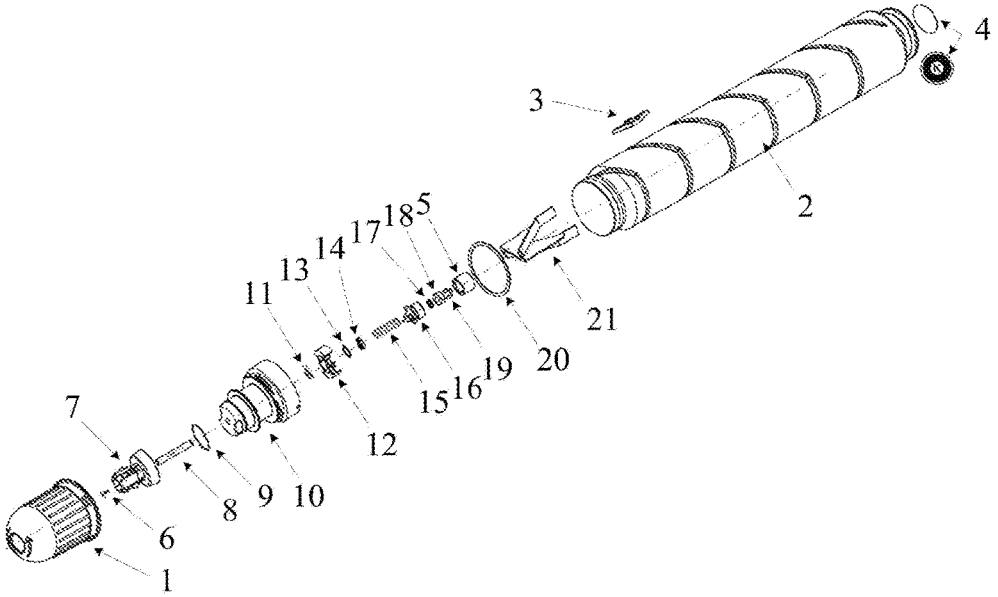
FIG. 8 is an explosive view of a cartridge according to the present invention.

In another aspect, the present invention also provides a cartridge comprising, as shown in FIG. 8, a cartridge body 2 and a cartridge top cover located at an upper portion of the cartridge body 2, wherein the cartridge top cover is the one mentioned above.

Compared with the prior art, the present invention reduces the energy consumption and avoids the equipment damage caused by the reverse rotation of the cartridge.

As an improvement of the present invention, a toner feeding holder 21 is located inside the cartridge top cover.

Further, the cartridge top cover is connected with the cartridge body 2 through a cartridge top cover seal ring 20.

In the present invention, the cartridge further comprises a cover 1 located on the drive coupler 7 for accommodating and protecting the cartridge.

A specific embodiment of the present invention while work is described as follows.

The driving device of the printer or copier is engaged with the drive coupler 7. In order to more closely engage the driving device with the drive coupler 7, the included angle of the stoppers 71*a* on the drive coupler 7 is in the range of 80°-85°. Firstly, the driving device pulls the drive coupler 7 out of the cartridge top cover housing 10 and then reversely rotates. Due to the characteristic of unidirectional rotation of the one-way bearing 18, the transmission rod 8 is able to reversely rotate relatively to the driving member 16. Meanwhile, the driving member 16 does not follow the transmission rod 8 to rotate reversely, so that neither the rotary cap 12 nor the cartridge body 2 rotates.

When the driving device of the copier or printer rotates forwardly, under the drive of the transmission rod 8, the driving member 16 rotates forwardly. Since the drive teeth 161 of the driving member 16 are engaged with the toothed portions of the rotary cap 12 (because both the drive teeth 161 and the toothed portions has arc-shaped edges fitted with each other, the drive teeth 161 and the toothed portions are able to be easily engaged with each other), the rotary cap 12 follows the driving member 16 to rotate forwardly; after the rotary cap 12 rotates by 0-90°, the toner outlet 122 of the rotary cap 12 is fully communicated with the notches 101 of the cartridge top cover housing 10 (since the cartridge top cover housing 10 has the arc-shaped notches 101 on the top portion thereof, which enlarges a cross sectional area of the toner outlet 122 for allowing the toner to flow out more easily). Because the inner side of the top portion of the cartridge top cover housing 10 is provided with the positioning column 104 for restriction, the rotary cap 12 is able to drive the cartridge top cover housing 10 to rotate forwardly for further driving the cartridge body 2 to rotate forwardly. With the rotation of the cartridge body 2, the toner continuously flows out of the toner outlet 122, so as to cooperate with the other parts of the copier or printer to complete printing and copying.

Under the action of the driving device of the copier or printer, the drive coupler 7 is able to slide downwardly from the top portion of the cartridge top cover housing 10, the drive teeth 161 of the driving member 16 are disengaged with the toothed portions of the rotary cap 12; due to an action of the return spring 11, the rotary cap 12 bounces back to an original position; the toner outlet 122 is closed and the toner stops flowing out.

It should be noted that the technical solutions of the present invention are adapted for many kinds of the printers or copiers, such as digital copiers.

The foregoing is a preferred embodiment of the present invention and it should be noted that those skilled in the art may make some improvements and modifications without departing from the principles of the present invention, and those improvements and modifications should be regarded to be within the protection scope of the present invention.

What is claimed is:

1. A cartridge top cover comprising a drive coupler, a cartridge top cover housing and a rotary cap rotatably located inside the cartridge top cover housing, wherein:

two notches are provided on a top portion of the cartridge top cover housing, the rotary cap has a toner outlet which is selectively communicated with the notches, a driving member capable of being engaged with the rotary cap is located inside the cartridge top cover housing, the driving member is in clearance fit with the cartridge top cover housing, the drive coupler is located at the top portion of the cartridge top cover housing, a transmission rod is located at a bottom of the drive coupler by screws, the transmission rod is sleeved through the top portion of the cartridge top cover housing and is connected with the driving member by a one-way bearing which is fixed inside the driving member;

multiple longitudinal grooves are uniformly provided on an outer side of the one-way bearing, and multiple fixed ribs are integrally formed at an inner side of the driving member for being engaged with the longitudinal grooves.

2. The cartridge top cover, as recited in claim 1, wherein: multiple toothed portions are located at a side of the rotary cap facing toward the driving member, multiple drive teeth for engaging with the rotary cap are located at a side of the driving member facing towards the rotary cap; each drive tooth has an upright edge along a rotational direction thereof, and an arc edge which is opposite to the upright edge and defined by gradually widening each drive tooth from a tip thereof.

3. The cartridge top cover, as recited in claim 2, wherein: every notch has a notch edge provided at the top portion of the cartridge top cover housing.

4. The cartridge top cover, as recited in claim 3, wherein: a seal ring is located inside the driving member for fitting with an end surface of the one-way bearing.

5. The cartridge top cover, as recited in claim 4, wherein: a driving member protective case is sleeved to a rear portion of the driving member.

6. The cartridge top cover, as recited in claim 5, wherein: each toothed portion has a curved edge along a rotational direction thereof which fits with the arc edge of each drive tooth, and a right-angel edge which is opposite to the curved edge and fits with the upright edge of each drive tooth.

7. The cartridge top cover, as recited in claim 6, wherein: multiple supporting sheets, which are in clearance fit with each other, are located at a top of the drive coupler; multiple stoppers are respectively located at the supporting sheets for being engaged with the driving device; each stopper has an included angle in a range of 80° to 85°.

8. The cartridge top cover, as recited in claim 7, wherein: a circlip is fixed at a bottom of the transmission rod;

a spring is located between the rotary cap and the driving member, a fixed ring is located between the rotary cap and the spring, and a PET (Polyethylene terephthalate) pad is located between the rotary cap and the fixed ring.

9. The cartridge top cover, as recited in claim 2, wherein: a seal ring is located inside the driving member for fitting with an end surface of the one-way bearing.

10. The cartridge top cover, as recited in claim 9, wherein: a driving member protective case is sleeved to a rear portion of the driving member.

11. The cartridge top cover, as recited in claim 10, wherein: each toothed portion has a curved edge along a rotational direction thereof which fits with the arc edge of each drive tooth, and a right-angel edge which is opposite to the curved edge and fits with the upright edge of each drive tooth.

12. The cartridge top cover, as recited in claim 11, wherein: multiple supporting sheets, which are in clearance fit with each other, are located at a top of the drive coupler; multiple stoppers are respectively located at the supporting sheets for being engaged with the driving device; each stopper has an included angle in a range of 80° to 85°.

13. The cartridge top cover, as recited in claim 12, wherein: a circlip is fixed at a bottom of the transmission rod;

a spring is located between the rotary cap and the driving member, a fixed ring is located between the rotary cap and the spring, and a PET (Polyethylene terephthalate) pad is located between the rotary cap and the fixed ring.

14. The cartridge top cover, as recited in claim 1, wherein: a seal ring is located inside the driving member for fitting with an end surface of the one-way bearing.

15. The cartridge top cover, as recited in claim 14, wherein: a driving member protective case is sleeved to a rear portion of the driving member.

16. The cartridge top cover, as recited in claim 15, wherein: each toothed portion has a curved edge along a rotational direction thereof which fits with the arc edge of each drive tooth, and a right-angel edge which is opposite to the curved edge and fits with the upright edge of each drive tooth.

17. The cartridge top cover, as recited in claim 16, wherein: multiple supporting sheets, which are in clearance fit with each other, are located at a top of the drive coupler; multiple stoppers are respectively located at the supporting sheets for being engaged with the driving device; each stopper has an included angle in a range of 80° to 85°.

18. The cartridge top cover, as recited in claim 15, wherein: a circlip is fixed at a bottom of the transmission rod;

a spring is located between the rotary cap and the driving member, a fixed ring is located between the rotary cap and the spring, and a PET (Polyethylene terephthalate) pad is located between the rotary cap and the fixed ring.

19. A cartridge comprising a cartridge body and a cartridge top cover located at an upper portion of the cartridge body, wherein:

the cartridge top cover comprises a drive coupler, a cartridge top cover housing and a rotary cap rotatably located inside the cartridge top cover housing;

two notches are respectively provided on both sides of a top portion of the cartridge top cover housing, the rotary cap has a toner outlet which is selectively communicated with the notches, a driving member capable of being engaged with the rotary cap is located inside the cartridge top cover housing, the driving member is in clearance fit with the cartridge top cover housing, the drive coupler is located at the top portion of the cartridge top cover housing, a transmission rod is located at a bottom of the drive coupler by screws, the transmission rod is sleeved through the top portion of the cartridge top cover housing and is connected with the driving member by a one-way bearing which is fixed inside the driving member;

multiple longitudinal grooves are uniformly provided on an outer side of the one-way bearing, and multiple fixed ribs are integrally formed at an inner side of the driving member for being engaged with the longitudinal grooves.

* * * * *